US008696924B2

(12) United States Patent
Tada et al.

(10) Patent No.: US 8,696,924 B2
(45) Date of Patent: Apr. 15, 2014

(54) POLISHING APPARATUS AND POLISHING METHOD

(75) Inventors: Mitsuo Tada, Tokyo (JP); Taro Takahashi, Tokyo (JP); Motohiro Niijima, Tokyo (JP); Shinro Ohta, Tokyo (JP); Atsushi Shigeta, Fujisawa (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 1169 days.

(21) Appl. No.: 11/730,891

(22) Filed: Apr. 4, 2007

(65) Prior Publication Data

US 2007/0239309 A1 Oct. 11, 2007

(30) Foreign Application Priority Data

Apr. 5, 2006 (JP) ..... 2006-104083

(51) Int. Cl.
*G06F 19/00* (2011.01)

(52) U.S. Cl.
USPC ..... 216/88; 700/121; 216/89; 216/90; 216/91; 451/5; 451/6; 451/66

(58) Field of Classification Search
USPC ..... 156/345.12, 345.13, 345.15, 345.16, 156/345.25, 345.14; 451/5, 6, 66; 216/89, 216/90, 91; 134/1.3, 902; 700/121
See application file for complete search history.

(56) References Cited

U.S. PATENT DOCUMENTS

| | | | | |
|---|---|---|---|---|
| 5,337,015 | A * | 8/1994 | Lustig et al. | 324/671 |
| 7,349,753 | B2 * | 3/2008 | Paik | 700/110 |
| 2004/0259470 | A1 * | 12/2004 | Swedek et al. | 451/5 |
| 2005/0142991 | A1 * | 6/2005 | Nakao et al. | 451/64 |
| 2007/0102116 | A1 * | 5/2007 | Shanmugasundram et al. | 156/345.13 |
| 2007/0239309 | A1 * | 10/2007 | Tada et al. | 700/121 |

FOREIGN PATENT DOCUMENTS

| | | |
|---|---|---|
| JP | 2005-011977 | 1/2005 |
| WO | WO2004113020 | * 12/2004 |

* cited by examiner

*Primary Examiner* — Sylvia R MacArthur
(74) *Attorney, Agent, or Firm* — Wenderoth, Lind & Ponack, L.L.P.

(57) ABSTRACT

A polishing apparatus is used for polishing and planarizing a substrate such as a semiconductor wafer on which a conductive film such as a copper (Cu) layer or a tungsten (W) layer is formed. The polishing apparatus includes a polishing table having a polishing surface, a motor for rotating the polishing table, a top ring for holding a substrate and pressing the substrate against the polishing surface, a film thickness measuring sensor disposed in the polishing table for scanning a surface of the substrate, and a computing device for processing signals of the film thickness measuring sensor to compute a film thickness of the substrate.

7 Claims, 3 Drawing Sheets

POLISHING APPARATUS AND POLISHING METHOD

BACKGROUND OF THE INVENTION

1. Field of the Invention

The present invention relates to a polishing apparatus and a polishing method, and more particularly to a polishing apparatus and a polishing method for polishing and planarizing a substrate such as a semiconductor wafer on which a conductive film such as a copper (Cu) layer or a tungsten (W) layer is formed. Further, the present invention relates to a program for measuring a film thickness of a substrate when the substrate is polished by such polishing apparatus and such polishing method.

2. Description of the Related Art

In order to form interconnect circuits on a semiconductor substrate, there has been known a process in which copper plating is performed to form a plated copper layer and an unnecessary portion of the plated copper layer thus formed is removed by chemical mechanical polishing (CMP) to form a copper interconnect layer. In this chemical mechanical polishing, it is necessary that the progress of polishing of a conductive film such as a copper layer should be exactly grasped and an end point of the polishing should be exactly detected. In order to detect such end point of the polishing, there has been known a method of measuring a film thickness of a conductive film using an optical sensor or a method of measuring a film thickness of a conductive film using an eddy current sensor for measuring a film thickness from a magnitude of the eddy current generated in a conductive film (for example Japanese Laid-open Patent Publication No. 2005-11977).

The eddy current sensor uses eddy current generated in a conductive film such as a metal film formed in a top layer of a semiconductor wafer to measure a film thickness of the conductive film. Specifically, a magnetic flux is formed by a sensor coil, and the magnetic flux passes through the conductive film of the semiconductor wafer located in front of the sensor coil, thus being alternatively changed. Thus, the eddy current is generated in the conductive film, and the eddy current flows in the conductive film to cause eddy current loss. In the eddy current sensor, the semiconductor wafer and the conductive film can be regarded as an equivalent circuit and the thickness of the conductive film on the semiconductor wafer can be measured by measuring the eddy current loss.

The film thickness to be measured by the eddy current sensor is a film thickness of a conductive film as the uppermost layer. However, the magnetic flux of the eddy current sensor is not limited only to the uppermost layer, and if a layer or layers that underlie the uppermost layer have conductivity, measurements by the eddy current sensor are affected by an underlayer or underlayers. Further, recently, interconnect layers formed by an interconnect forming process become high density and are multilayered, and the upper layer tends to have an interconnect width wider than an interconnect width of the lower layer and an interconnect thickness thicker than an interconnect thickness of the lower layer. Therefore, as the number of laminations of interconnect circuits increases, output signals from the eddy current sensor are more highly affected by the underlayer or underlayers. The output signals which have been affected by the underlayer or underlayers do not reflect polishing conditions exactly, and thus detection of an end point of the polishing becomes unstable. Therefore, there has been developed a method in which a semiconductor wafer is divided into a plurality of zones and an end point of the polishing is detected on the basis of features of signals obtained from the respective zones.

An interconnect forming process of the semiconductor wafer is normally carried out by forming a plurality of dies (part in which electronic circuits are formed) on a single wafer. In general, a conductive material such as a metal for interconnect formation is not formed between the adjacent dies. Therefore, in the case where the stage of lamination progresses, the signal wave form of the eddy current sensor at a measurement point on the die is quite different from signal wave form of the eddy current sensor at a measurement point located between the adjacent dies. Since the semiconductor wafer is rotated during polishing, even if the same zone is measured, the proportion of the dies in the zone is changed for each measurement. As a result, exact data cannot be obtained. In order to reduce such influence, there has been developed a method in which data obtained by an eddy current sensor are smoothed over an entire surface of a semiconductor wafer to detect an end point of polishing, without division of zones.

As described above, when the end point of the polishing is being detected, it is difficult to measure the film thickness stably by the influence of noise in the interconnect layer, during polishing, or the influence of the interconnect pattern of the underlying layer. Further, it is difficult to obtain information about the film thickness by smoothing signals from the sensor over the entire surface of the wafer. Even if the end point of the polishing is detected from data regarding the film thickness which have been affected by such noise or such interconnect pattern of the underlying layer, the end point of the polishing cannot be detected stably.

SUMMARY OF THE INVENTION

The present invention has been made in view of the above drawbacks. It is therefore a first object of the present invention to provide a polishing apparatus and a polishing method which can detect an end point of the polishing stably and can achieve high-quality polishing without being affected by noise or the interconnect pattern of the underlying layer.

Further, a second object of the present invention is to provide a program for measuring a film thickness of a substrate which can grasp a polishing state of the interconnect layer exactly and can detect an end point of the polishing stably without being affected by noise or the interconnect pattern of the underlying layer.

According to a first aspect of the present invention, there is provided a polishing apparatus which can detect an endpoint of the polishing stably and can achieve high-quality polishing without being affected by noise or the interconnect pattern of the underlying layer. The polishing apparatus comprises a polishing table having a polishing surface; a motor for rotating the polishing table; a top ring for holding a substrate and pressing the substrate against the polishing surface; a film thickness measuring sensor disposed in the polishing table for scanning a surface of the substrate; and a computing device for processing signals of the film thickness measuring sensor to compute a film thickness of the substrate. The computing device comprises a representative value generating device for generating a representative value from signals of the film thickness measuring sensor generated during the previous rotation of the polishing table; a correction device for outputting the representative value when values of the signals of the film thickness measuring sensor are larger than the representative value, and outputting the signals of the film thickness measuring sensor when values of the signals of the film thickness measuring device are smaller than the representative value; and a film thickness computing device for computing the film thickness of the substrate from the signals outputted from the correction device.

In a preferred aspect of the present invention, a plurality of dies are formed on the substrate, and the computing device is configured to divide scanning data on the substrate obtained by the film thickness measuring sensor into a plurality of zones having a size larger than the die and to compute the film thickness of the substrate by processing the signals of the film thickness measuring sensor in each of the plurality of zones on the substrate using the representative value generated in each of the plurality of zones by the representative value generating device.

In a preferred aspect of the present invention, the representative value generating device generates the representative value from the signals of the film thickness measuring sensor generated during rotation of the polishing table one time ago.

In a preferred aspect of the present invention, the representative value generating device obtains the representative value by adding a predetermined correction value to the minimum value of the signals of the film thickness measuring sensor within a certain period of time.

In a preferred aspect of the present invention, the representative value generating device obtains the predetermined correction value by multiplying the difference between the maximum value and the minimum value of the signals of the film thickness measuring sensor within the certain period of time by a predetermined coefficient.

In a preferred aspect of the present invention, the film thickness measuring sensor comprises at least one of an eddy current sensor, an optical sensor and a microwave sensor.

In a preferred aspect of the present invention, the film thickness measuring sensor comprises an eddy current sensor.

According to a second aspect of the present invention, there is provided a polishing method which can grasp a polishing state of the interconnect layer and can detect an end point of the polishing stably without being affected by noise or the interconnect pattern of the underlying layer. The polishing method is configured to polish a substrate by pressing the substrate against a polishing surface on a rotating polishing table. The polishing method comprises scanning the substrate by a film thickness measuring sensor disposed in the polishing table; generating a representative value from signals of the film thickness measuring sensor generated during the previous rotation of the polishing table; outputting the representative value when values of the signals of the film thickness measuring sensor are larger than the representative value, and outputting the signals of the film thickness measuring sensor when values of the signals of the film thickness measuring device are smaller than the representative value; and computing a film thickness of the substrate from the outputted signals.

In a preferred aspect of the present invention, scanning data on the substrate obtained by the film thickness measuring sensor is divided into a plurality of zones having a size larger than a die formed on the substrate; and the film thickness of the substrate is computed by processing the signals of the film thickness measuring sensor in each of the plurality of zones on the substrate using the representative value generated in each of the plurality of zones.

In a preferred aspect of the present invention, the representative value is generated from the signals of the film thickness measuring sensor generated during rotation of the polishing table one time ago.

In a preferred aspect of the present invention, the representative value is obtained by adding a predetermined correction value to the minimum value of the signals of the film thickness measuring sensor within a certain period of time.

In a preferred aspect of the present invention, the predetermined correction value is obtained by multiplying the difference between the maximum value and the minimum value of the signals of the film thickness measuring sensor within the certain period of time by a predetermined coefficient.

In a preferred aspect of the present invention, the film thickness measuring sensor comprises at least one of an eddy current sensor, an optical sensor and a microwave sensor.

In a preferred aspect of the present invention, the film thickness measuring sensor comprises an eddy current sensor.

According to a third aspect of the present invention, there is provided a program for measuring a film thickness of a substrate which can grasp a polishing state of the interconnect layer and can detect an end point of the polishing stably without being affected by noise or the interconnect pattern of the underlying layer. The film thickness measuring program is configured to measure a film thickness of a substrate on the basis of signals of a film thickness measuring sensor disposed in a polishing table for use in a polishing apparatus for polishing the substrate by pressing the substrate against a polishing surface on the polishing table. The film thickness measuring program makes a computer function as: means for obtaining a representative value by adding a predetermined correction value to the minimum value of the signals of the film thickness measuring sensor generated during rotation of the polishing table one time ago within a certain period of time; means for outputting the representative value when values of the signals of the film thickness measuring sensor are larger than the representative value, and outputting the signals of the film thickness measuring sensor when values of the signals of the film thickness measuring device are smaller than the representative value; and means for computing the film thickness of the substrate from the outputted signals.

In a preferred aspect of the present invention, the predetermined correction value comprises a value obtained by multiplying the difference between the maximum value and the minimum value of the signals of the film thickness measuring sensor by a predetermined coefficient.

According to the present invention, the representative value generated from signals of the film thickness measuring sensor obtained by the previous rotation of the polishing table is used as a threshold value, and signals larger than the representative value are judged as noise and are cut. Therefore, any effect of noise or the interconnect pattern of the underlying layer can be reduced. Thus, the polishing state of the interconnect layer can be grasped exactly, and the end point of the polishing can be detected stably.

DETAILED DESCRIPTION OF THE PREFERRED EMBODIMENTS

Figure 1:
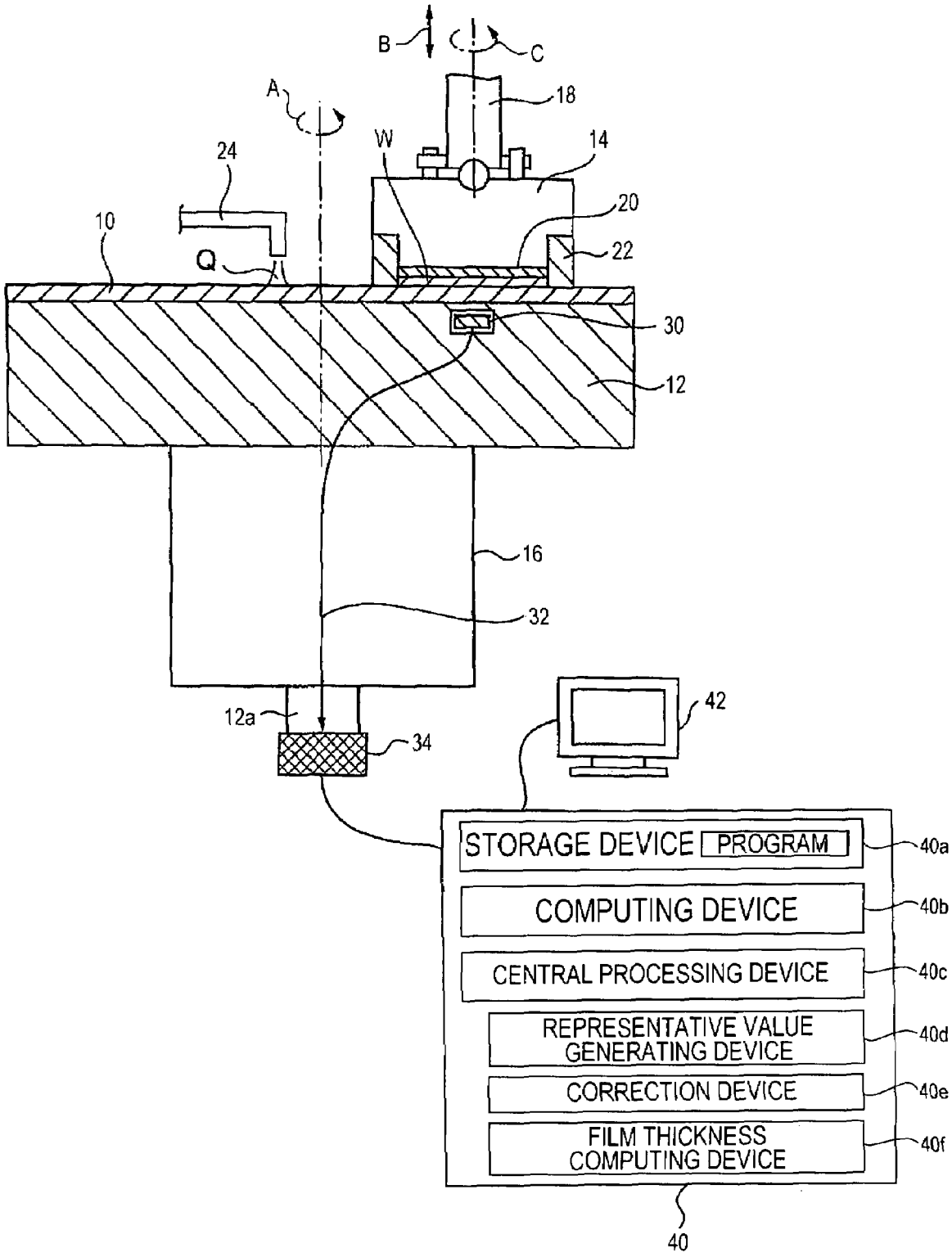
FIG. 1 is a schematic view showing a polishing apparatus according to an embodiment of the present invention.

A polishing apparatus according to an embodiment of the present invention will be described below with reference to FIGS. 1 through 3C. In FIGS. 1 through 3C, the same or corresponding members or elements are denoted by the same reference numerals and will not be described repetitively.

FIG. 1 is a schematic view showing a polishing apparatus according to an embodiment of the present invention. As shown in FIG. 1, the polishing apparatus comprises a polishing table 12 having a polishing pad 10 serving as a polishing surface mounted thereon, and a top ring 14 for holding a semiconductor wafer W and pressing the semiconductor wafer W against the polishing pad 10 of the polishing table 12. The polishing table 12 is coupled to a motor 16 and is rotatable about its axis as shown by an arrow A in FIG. 1.

The top ring 14 is connected to a motor (not shown) and a lifting/lowering cylinder (not shown). Thus, the top ring 14 is movable vertically and rotatable about its own axis as indicated by the arrows B and C in FIG. 1. With such an arrangement, the top ring 14 can press the semiconductor wafer W against the polishing pad 10 under a desired pressure while being rotated.

The top ring 14 is coupled to a top ring shaft 18, and has an elastic pad 20 made of polyurethane or the like on a lower surface thereof. The top ring 14 has a guide ring 22 disposed around a lower outer peripheral portion of the top ring 14 for preventing the semiconductor wafer W from being dislodged from the top ring 14. A polishing liquid supply nozzle 24 is disposed above the polishing table 12 for supplying a polishing liquid Q onto the polishing pad 10.

As shown in FIG. 1, an eddy current sensor 30 serving as a film thickness measuring sensor for measuring a thickness of a film formed on a semiconductor wafer W is embedded in the polishing table 12. The eddy current sensor 30 is electrically connected to a controller 40 by a connection cable 32 extending through the polishing table 12, a table support shaft 12*a*, and a rotary connector (or slip ring) 34 mounted on the lower end of the table support shaft 12*a*.

The controller 40 is composed of a computer comprising a storage device 40*a* for storing data from the eddy current sensor 30 and other data and a computing device 40*b* for computing a film thickness of the semiconductor wafer W by processing output signals from the eddy current sensor 30. The storage device 40*a* has a predetermined program therein, and this program is loaded in a central processing device 40*c* of the computer, and thus a representative value generating device 40*d*, a correction device 40*e*, a film thickness computing device 40*f*, and the like (described later) are constituted. The controller 40 is connected to a display device 42.

Figure 2:
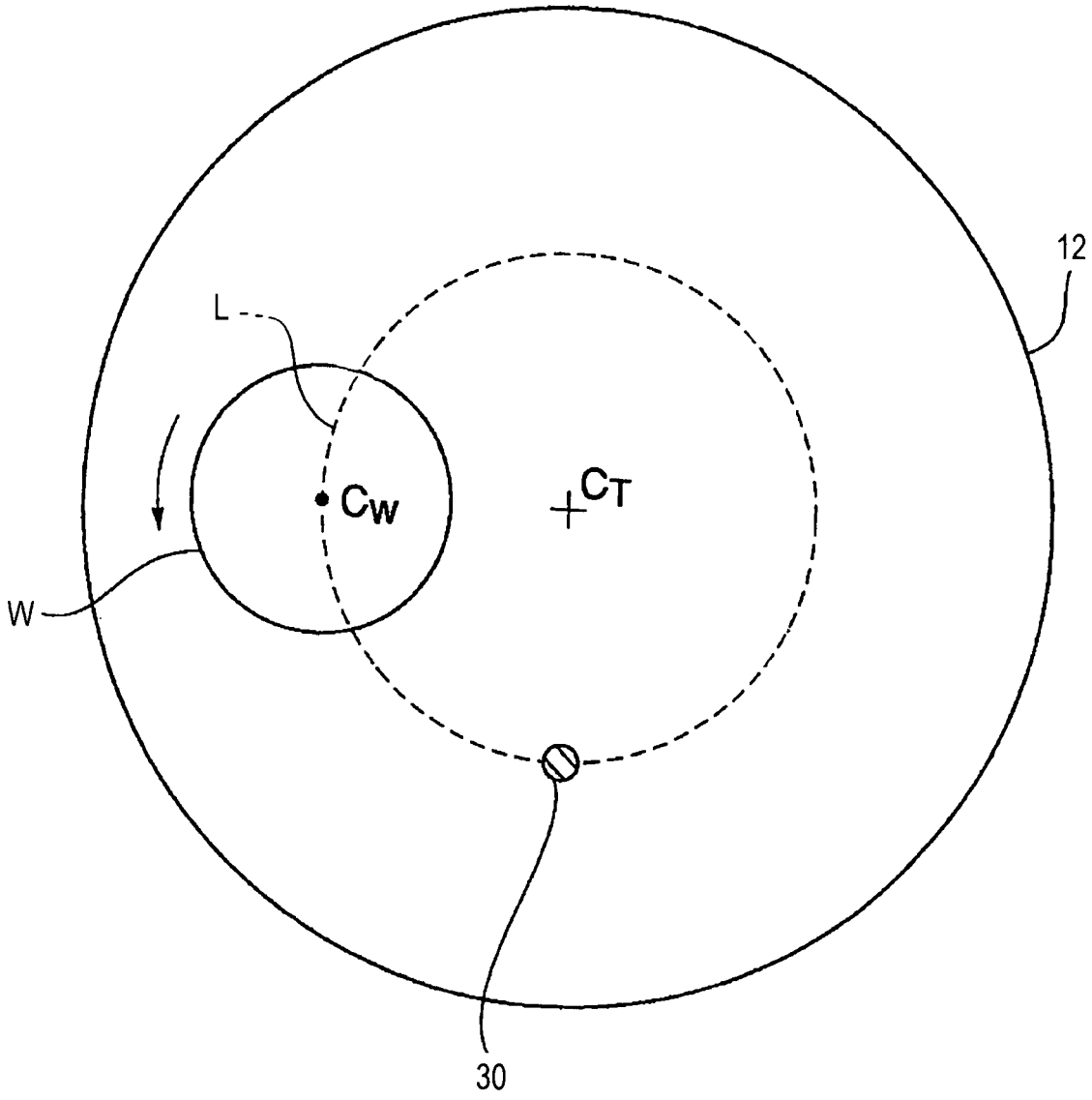
FIG. 2 is a plan view of the polishing apparatus shown in FIG. 1.

FIG. 2 is a plan view of the polishing apparatus shown in FIG. 1. As shown in FIG. 2, the eddy current sensor 30 is positioned so as to pass across a center $C_W$ of the semiconductor wafer W which is held by the top ring 14 and is being polished. The polishing table 12 has a center $C_T$ about which it is rotated. While the eddy current sensor 30 is moving below the semiconductor wafer W, the eddy current sensor 30 can continuously detect a film thickness of a conductive film such as a copper layer or a barrier layer of the semiconductor wafer W along an arcuate path L.

With the polishing apparatus thus constructed, the semiconductor wafer W held on the lower surface of the top ring 14 is pressed against the polishing pad 10 on the upper surface of the polishing table 12 which is rotated. At this time, the polishing liquid Q is supplied onto the polishing pad 10 from the polishing liquid supply nozzle 24. Thus, the semiconductor wafer W is polished with the polishing liquid Q being present between the lower surface, being polished, of the semiconductor wafer W and the polishing pad 10.

During polishing, the eddy current sensor 30 passes through immediately below the lower surface of the semiconductor wafer W each time the polishing table 12 makes one revolution. As described above, because the eddy current sensor 30 is positioned so as to pass across the center Cw of the semiconductor wafer W along the arcuate path L, the eddy current sensor 30 can continuously detect the film thickness of the semiconductor wafer W along the arcuate path L located on the lower surface of the semiconductor wafer W while the eddy current sensor 30 is moving below the semiconductor wafer W.

Each time the polishing table 12 makes one revolution, the eddy current sensor 30 scans the lower surface of the semiconductor wafer W one time, and the representative value generating device 40*d* in the controller 40 generates representative values from signals obtained by the eddy current sensor 30. According to the present embodiment, the arcuate path L on the semiconductor wafer W is divided into a plurality of zones (for example, five zones), and a representative value of the output signals of the eddy current sensor 30 is generated in each zone. The operating conditions are set such that the size of each zone is larger than the size of the die, and a plurality of dies and regions between two adjacent dies are included in each zone. Since the semiconductor wafer W is divided into a plurality of zones, a polishing state and a film thickness of the semiconductor wafer W can be obtained in each zone during polishing. Thus, process analysis can be performed on the basis of the obtained data including the polishing state and the film thickness.

Figure 3A:
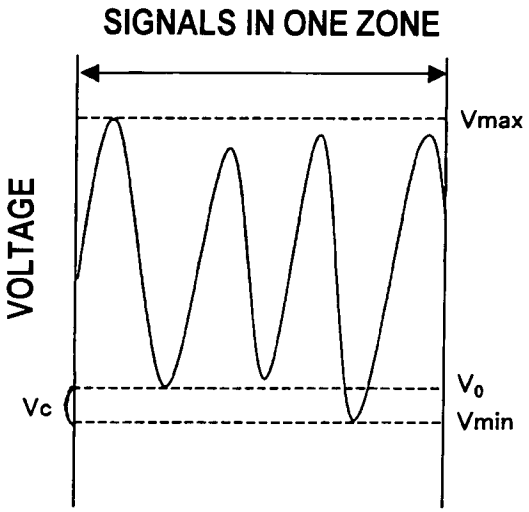
FIGS. 3A and 3B are graphs showing examples of output signals from an eddy current sensor shown in FIG. 1.

For example, it is assumed that signals as shown in FIG. 3A are obtained in a certain zone by the eddy current sensor 30, a representative value is generated from the obtained signals by the representative value generating device 40*d* in the controller 40. Specifically, the representative value generating device 40*d* in the controller 40 obtains the minimum value $V_{min}$ of signal values in the certain zone, and a representative value Vo is obtained by adding a predetermined correction value Vc to the minimum value $V_{min}$. The equation is given as follows:

$$Vo=V_{min}+Vc$$

It is desirable that the correction value Vc is determined so as to be effective in reducing noise on the basis of noise period, the size of die of the semiconductor wafer W, patterns of the semiconductor wafer W depending on the position of the die, and polishing conditions such as a rotational speed of the top ring 14 or a rotational speed of the polishing table 12.

Figure 3B:
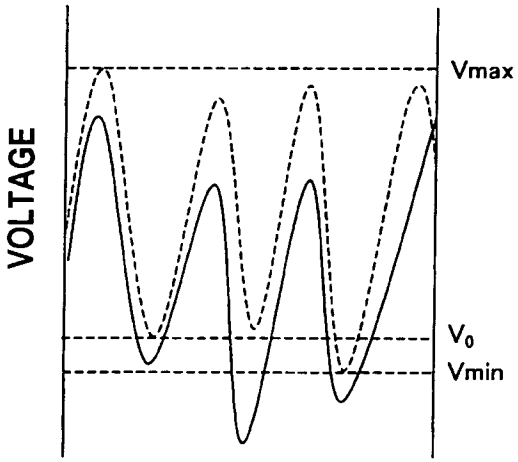
Figure 3C:
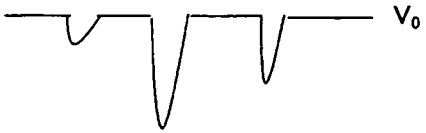
FIG. 3C is a graph showing an example of signals after correction of the output signals shown in FIG. 3B.

In this manner, after the representative value Vo is generated in each zone by the representative value generating device 40*d* in the controller 40, when the eddy current sensor 30 scans the lower surface of the semiconductor wafer W one time at the time of the subsequent rotation, output signals from the eddy current sensor 30 are corrected on the basis of the representative value Vo. Specifically, it is assumed that signals shown by a solid line in FIG. 3B are obtained at the time of the subsequent rotation of the polishing table 12, the correction device 40*e* in the controller 40 outputs the representative value Vo when the obtained signals are larger than the representative value Vo, and outputs signals from the eddy current sensor 30 as they are when the obtained signals are smaller than the representative value Vo. Thus, signals as shown in FIG. 3C are outputted from the correction device 40*e*.

Next, the film thickness computing device 40*f* in the controller 40 computes a film thickness of the semiconductor wafer Won the basis of the signals outputted from the correction device 40*e*. For example, the signals shown in FIG. 3C are integrated, and a film thickness corresponding to the integral value is calculated. Thus, according to the present embodiment, output signals of the eddy current sensor 30 generated at the current rotation are corrected on the basis of output signals of the eddy current sensor 30 generated during rotation of the polishing table 12 one time ago (i.e., during the previous rotation). That is, a value obtained by adding a predetermined correction value to the minimum value of signals generated during rotation of the polishing table 12 one time ago is used as a representative value (threshold value), and signals (voltage) larger than the representative value are cut and only signals smaller than the representative value are employed. Thus, any effect of the metal layer as an underlying layer on output signals of the eddy current sensor can be eliminated.

Specifically, as the output signals from the eddy current sensor are smaller, the effect caused by noise or the pattern of the semiconductor wafer W becomes smaller. Further, as polishing of the semiconductor wafer W progresses, values of output signals tend to become gradually smaller. Therefore, the above-mentioned representative value is used as a threshold value, and signals larger than the representative value are judged as noise and are cut. Thus, any effect of noise or the interconnect pattern of the underlying layer can be reduced. As a result, the polishing state of the interconnect layer can be grasped exactly, and the end point of the polishing can be detected stably.

In the above example, the representative value generating device 40*d* in the controller 40 generates the above representative value from signals of the eddy current sensor 30 generated during rotation of the polishing table 12 one time ago. However, the generation of the representative value is not limited to this example, and a representative value may be generated from signals of the eddy current sensor 30 generated during rotation of the polishing table 12 several times ago. Further, the correction value Vc may be constant. Instead, a value obtained by multiplying a difference between the maximum value $V_{max}$ and the minimum value $V_{min}$ of the signals of the eddy current sensor 30 generated during rotation of the polishing table 12 one time ago (or several times ago) by a predetermined coefficient k may be taken as the above correction value Vc. The equations are given as follows:

$$Vc=k(V_{max}-V_{min})$$

$$V_O=V_{min}+Vc=V_{min}+k(V_{max}-V_{min})$$

Here, k is constant of less than 1, and it is desirable that k is determined so as to be effective in reducing noise on the basis of the noise period, the size of the die of the semiconductor wafer W, patterns of the semiconductor wafer W depending on the position of the die, and polishing conditions such as a rotational speed of the top ring 14 or a rotational speed of the polishing table 12.

Further, when the eddy current sensor 30 is positioned outside an area of the semiconductor wafer W, a value obtained by adding a predetermined value to the minimum value of signals of the eddy current sensor 30 within the area of the semiconductor wafer W or a value obtained by adding the minimum value to a value obtained by multiplying the difference between the maximum value and the minimum value by a predetermined coefficient may be taken as a hypothetical output signal. Specifically, only data generated when the eddy current sensor 30 scans the semiconductor wafer W is not outputted, but data generated at another time are replaced by the above value which is then outputted. Thus, data on the basis of real time of the polishing process can be outputted, and polishing operations such as feedback control can be easily adjusted.

Although the eddy current sensor is used as a film thickness measuring sensor in the present embodiment, the film thickness measuring sensor which can be used in the present invention is not limited to the eddy current sensor. For example, an optical sensor or a microwave sensor may be used as a film thickness measuring sensor.

Although copper is used as an interconnect forming material in the present embodiment, aluminum, tungsten, aluminum alloy or tungsten alloy can be also used as an interconnect forming material in the present invention.

Although certain preferred embodiments of the present invention have been shown and described in detail, it should be understood that various changes and modifications may be made therein without departing from the scope of the appended claims.

What is claimed is:

1. A polishing method for polishing a substrate by pressing the substrate against a polishing surface on a rotating polishing table, the polishing method comprising:

scanning the substrate with a film thickness measuring sensor disposed in the polishing table and outputting a sensor signal;

generating a representative value from the sensor signal of the film thickness measuring sensor generated during a previous rotation of the polishing table;

outputting a corrected signal, the corrected signal having the representative value when a value of the sensor signal of the film thickness measuring sensor generated during a current rotation of the polishing table is larger than the representative value and having the value of the sensor signal of the film thickness measuring sensor generated during the current rotation of the polishing table when the value of the sensor signal of the film thickness measuring sensor generated during the current rotation of the polishing table is smaller than the representative value; and computing a film thickness of the substrate from the outputted corrected signal.

2. The polishing method according to claim 1, wherein scanning data on the substrate obtained by the film thickness measuring sensor is divided into a plurality of zones having a size larger than a die formed on the substrate, and said computing of the film thickness of the substrate comprises processing a sensor signal of the film thickness measuring sensor in each of the plurality of zones on the substrate using a respective representative value generated in each of the plurality of zones.

3. The polishing method according to claim 1, wherein said generating of the representative value comprises generating the representative value from the sensor signal of the film thickness measuring sensor generated during an immediately preceding rotation of the polishing table.

4. The polishing method according to claim 1, wherein said generating of the representative value comprises generating the representative value by adding a predetermined correction value to a minimum value of the sensor signal of the film thickness measuring sensor within a certain period of time.

5. The polishing method according to claim 4, wherein said generating of the representative value comprises obtaining the predetermined correction value by multiplying a difference between a maximum value and the minimum value of the sensor signal of the film thickness measuring sensor within the certain period of time by a predetermined coefficient.

6. The polishing method according to claim 1, wherein the film thickness measuring sensor comprises at least one of an eddy current sensor, an optical sensor and a microwave sensor.

7. The polishing method according to claim 1, wherein the film thickness measuring sensor comprises an eddy current sensor.

* * * * *